United States Patent [19]

Schultz

[11] 4,413,165

[45] Nov. 1, 1983

[54] OUTDOOR HIGH VOLTAGE CIRCUIT BREAKER

[75] Inventor: Thomas Schultz, Berlin, Fed. Rep. of Germany

[73] Assignee: Siemens Aktiengesellschaft, Berlin and Munich, Fed. Rep. of Germany

[21] Appl. No.: 242,910

[22] Filed: Mar. 12, 1981

[30] Foreign Application Priority Data

Mar. 13, 1980 [DE] Fed. Rep. of Germany ..... 3009993

[51] Int. Cl.[3] ..... H01H 33/24

[52] U.S. Cl. ..... 200/148 H; 200/148 R; 174/140 R; 174/140 CR; 174/144

[58] Field of Search ..... 200/148 H, 148 R, 144 R; 174/140 R, 140 CR, 144

[56] References Cited

U.S. PATENT DOCUMENTS 3,046,327 7/1962 Harmon ..... 174/144

3,973,078 8/1976 Wolf et al. ..... 174/42

FOREIGN PATENT DOCUMENTS 2708660 8/1978 Fed. Rep. of Germany ..... 174/144

204611 8/1939 Switzerland ..... 200/148 H

*Primary Examiner*—Robert S. Macon

*Attorney, Agent, or Firm*—Karl F. Milde, Jr; Andrew G. Rodau

[57] ABSTRACT

In order to prevent sparking or corona effects in the high voltage carrying parts of the outdoor high voltage circuit breaker, shielding electrodes are provided. The shielding electrodes are angular frames. The frames are formed of hollow cylindrical straight rods and of substantially spherical corner pieces which connect the rods with each other. With this design, there are minimum costs of the component parts for shielding electrodes of varying size and shape.

11 Claims, 3 Drawing Figures

OUTDOOR HIGH VOLTAGE CIRCUIT BREAKER

BACKGROUND OF THE INVENTION

1. Field of the Invention

This invention relates to an open air or outdoor high voltage circuit breaker. In particular, this invention relates to a circuit breaker having shielding electrodes for minimizing or preventing sparking, spray discharges and/or corona discharges in the area of its voltage-carrying outer parts and its connecting elements.

2. Description of the Prior Art

Open air or outdoor high voltage circuit breakers tend to spark and to form corona discharges in the range of their high voltage-carrying parts when they are operated with high voltages for instance above 345 kV. In order to prevent these effects, it is known, e.g. from U.S. Pat. No. 3,973,078, to arrange a disk-shaped electrode between the insulating support for the interrupting units and the box containing these interrupters and carrying high voltage potential. Instead of such disk-shaped shielding electrodes annular electrodes can also be provided. The disk-shaped shielding electrodes are as a rule designed as castings, while the annular electrodes are formed from metal pipes. Furthermore, rolled or pressed sheet metal parts are also known as shielding electrodes.

SUMMARY OF THE INVENTION

1. Objects

It is an object of this invention to design the shielding electrodes in an outdoor high voltage circuit breaker such that shielding electrodes of different size and shape can be produced with a small effort in terms of parts.

It is another object of this invention to provide shielding electrodes of various sizes and shapes which require only a small number of different types of component parts or semifinished products.

2. Summary

According to this invention the shielding electrodes of the high voltage circuit breaker are angular frames which are formed of hollow cylindrical straight rods and of substantially spherical corner pieces.

By using the present invention, it is possible to produce a shielding electrode that consists of only two different types of component parts or semifinished products. One of these parts is the substantially spherical corner piece, while the other is the hollow cylindrical straight frame part which may be a section of a pipe. The frames may be quadrangular or triangular.

The free ends of the rods may be inserted into bores provided in the corner pieces. They may be fixed therein by holding elements arranged transversely to the rod axis, for instance by screw bolts. The corner pieces may be designed as castings. Preferably they are provided with connecting tabs for fastening the frame on the circuit breaker. These connecting tabs are preferably arranged in the plane of the frame, particularly on that side which is directed toward the interior of the frame. This ensures that the connecting points are in the field shade.

The foregoing and other objects, features and advantages of the invention will be apparent from the following more particular description of preferred embodiments of the invention, as illustrated in the accompanying drawings.

DETAILED DESCRIPTION OF THE PREFERRED EMBODIMENTS

Figure 1:
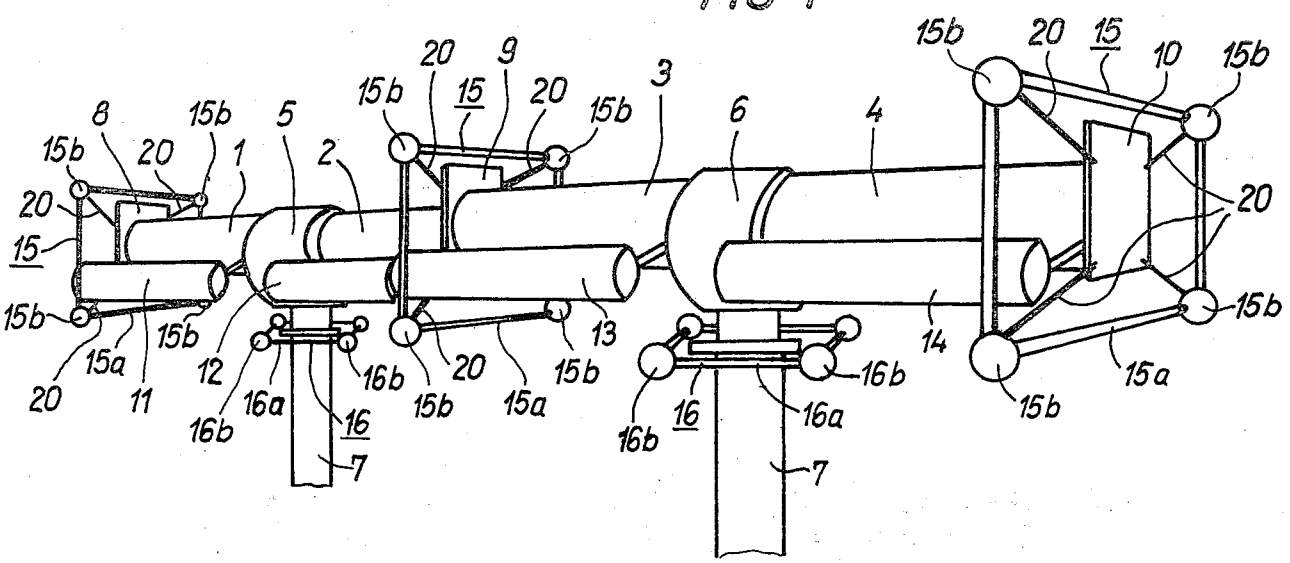
FIG. 1 is a perspective view of the upper part of an outdoor high voltage circuit breaker according to the invention.

FIG. 1 shows in a perspective view one pole or phase of an open air or outdoor high voltage circuit breaker for voltages about 345 kV. The series-connected interrupting units or interrupters 1, 2, 3 and 4 of the circuit breaker are operated in pairs by mechanical control gears 5 and 6. That is, the control gear 5 operates the interrupters 1 and 2, and the control gear 6 operates the interrupters 3 and 4. The control gears 5 and 6 are arranged on hollow cylindrical pin insulators or supports 7 insulated from the ground. The upstanding insulating supports 7 in turn are secured on well known base assemblies or lower supporting structures. In the operating mode, the control gears 5 and 6 carry high voltage. The usual and well known connecting elements or connectors 8, 9 and 10 at the outer ends of each pair of interrupters 1, 2 and 3, 4 also carry high voltage.

In the embodiment illustrated in FIG. 1, switching resistors or capacitors 11, 12, 13 and 14 are associated with the interrupters 1 to 4, respectively. These elements 11–14 likewise carry high voltage potential. Shielding electrodes 15 and 16 are provided which consist of angular frames which frames may be quadrangular or triangular. The angular frames 15 and 16 are formed of hollow cylindrical rods **15*a* and 16*a*, respectively, which are interconnected via corner pieces 15*b* and 16*b*, respectively, that are substantially spherical. In the embodiment illustrated in FIG. 1, the frame 15 is chosen to be quadrangular because of the arrangement of the switching resistors or capacitors 11, 12, 13 and 14. The angular shielding frames 15, 16 formed by the rods 15*a* and 16*a* are positioned at connections of and to the interruptors 1, 2, 3 and 4, i.e. at each connector 8, 9 and 10 and also at the insulating supports 7. The frames 15 are assembled by connecting the rods 15*a* through support arms 20 to the connectors 8, 9 and 10. The connectors 8, 9 and 10 serve as support plates for mounting the shielding angular frame. The support arms 20 are attached to the frame 15 by tabs 19 on the spherical corner elements 15*b***.

The support arms 20 and connecting tabs 19 are positioned to lie within the field shade.

Figure 2:
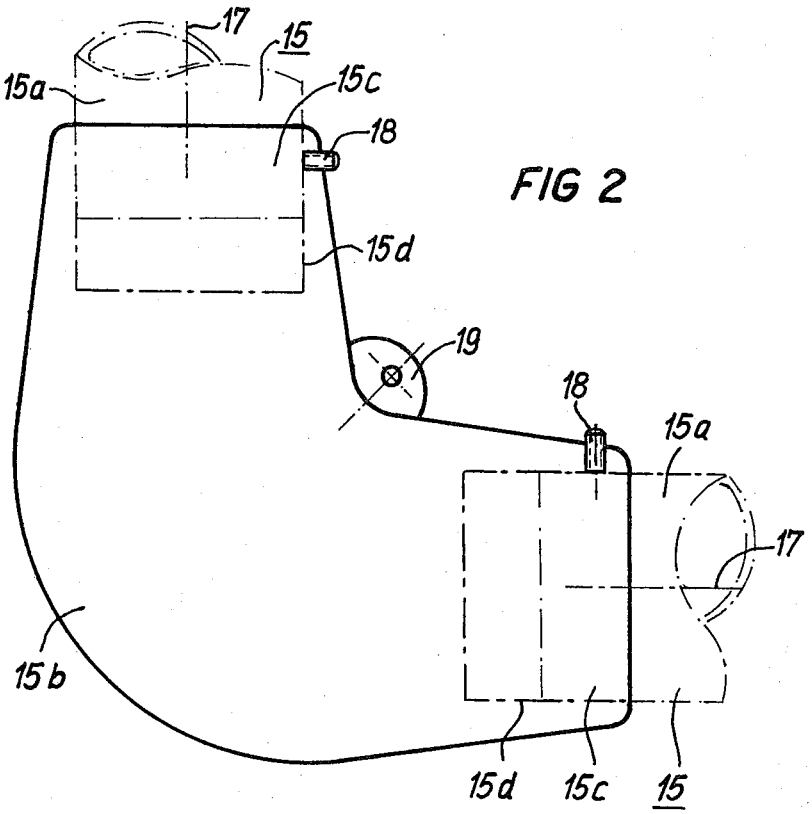
FIG. 2 is a side view of a corner piece used as a component of a frame-type shielding electrode illustrated in FIG. 1.
Figure 3:
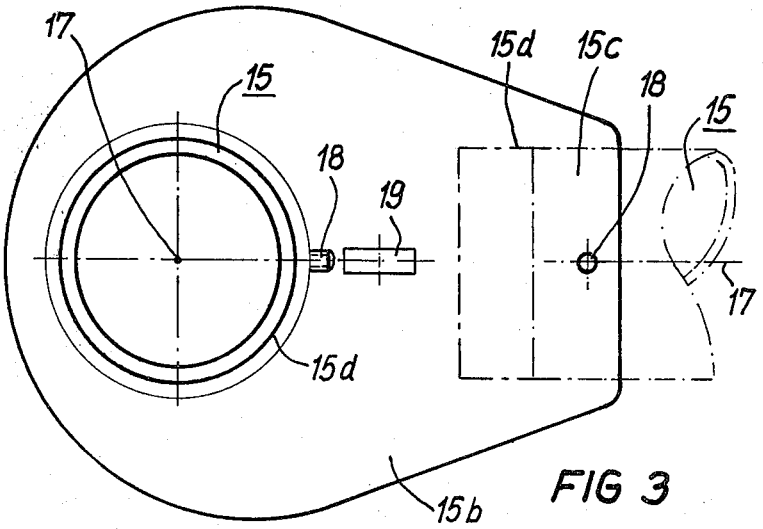
FIG. 3 is a top or plan view of the corner piece illustrated in FIG. 2.

As represented schematically in FIGS. 2 and 3 in an elevation view and in a top view, respectively, the free ends **15*c* of the rods 15*a* can be inserted into bores 15*d* of the corner pieces 15*b*. They can be fixed therein by holding elements 18 which are arranged transversely to the rod axis 17. The corner pieces 15*b* can be designed as castings. They can have connecting tabs 19 for fastening the frame 15 to the circuit breaker, as shown in FIGS. 2 and 3. It will be noted that the connecting tabs 19 are arranged in the plane of the frame 15 on that side which is directed toward the interior of the frame 15**.

While the forms of the outdoor high voltage circuit breaker herein described constitute preferred embodiments of the invention, it is to be understood that the invention is not limited to these precise forms of assembly, and that a variety of changes may be made therein without departing from the scope of the invention.

What is claimed is:

1. In an outdoor high voltage circuit breaker containing parts carrying said high voltage and shielding electrodes for preventing spraying or corona discharges in the area of said parts, the improvement comprising shielding electrodes in the form of angular frames, each of said frames being formed of hollow cylindrical rods and of substantially spherical corner pieces, said corner pieces interconnecting said rods.

2. The improvement according to claim 1, wherein said frame is quadrangular.

3. The improvement according to claim 1, wherein said corner pieces contain bores, wherein holding elements are provided transversely to the axis of said rods, and wherein the free ends of said rods are inserted into said bores and are fixed therein by said holding elements.

4. The improvement according to claim 1, wherein said corner pieces are casting pieces.

5. The improvement according to claim 1, wherein said corner pieces are provided with connecting tabs for connecting said frame to said circuit breaker.

6. The improvement according to claim 5, wherein said connecting tabs are provided in the plane of said frame on a side facing the interior of said frame.

7. The improvement according to claim 1, wherein said circuit breaker contains voltage carrying outer parts and connecting elements, and wherein said shielding electrodes are provided for shielding said voltage-carrying outer parts and said connecting elements.

8. The improvement according to claim 7, wherein said circuit breaker contains a plurality of interrupting units, and wherein said voltage-carrying outer parts are mechanical control gears, each of said gears being arranged between two interrupting units.

9. The improvement according to claim 1, wherein said circuit breaker contains upstanding insulating supports, and wherein said frames are arranged on the upper end portions of said supports.

10. The improvement according to claim 1, wherein said frames are provided with supporting arms.

11. The improvement according to claim 1, wherein said hollow cylindrical rods are straight rods.

* * * * *